US008651762B2

(12) United States Patent
Nakatani et al.

(10) Patent No.: US 8,651,762 B2
(45) Date of Patent: Feb. 18, 2014

(54) TIP UNIT FOR LIQUID APPLICATOR AND LIQUID APPLICATOR

(75) Inventors: Yasunori Nakatani, Osaka (JP); Sakiko Takahashi, Osaka (JP)

(73) Assignee: Sakura Color Products Corporation (JP)

( * ) Notice: Subject to any disclaimer, the term of this patent is extended or adjusted under 35 U.S.C. 154(b) by 460 days.

(21) Appl. No.: 13/127,629

(22) PCT Filed: Nov. 10, 2009

(86) PCT No.: PCT/JP2009/069084
§ 371 (c)(1),
(2), (4) Date: May 4, 2011

(87) PCT Pub. No.: WO2010/055821
PCT Pub. Date: May 20, 2010

(65) Prior Publication Data

US 2011/0274477 A1 Nov. 10, 2011

(30) Foreign Application Priority Data

Nov. 11, 2008 (JP) ..... 2008-289064

(51) Int. Cl.
*B43K 7/00* (2006.01)
*B43K 7/10* (2006.01)

(52) U.S. Cl.
USPC ..... 401/216; 401/208; 401/209; 401/212; 401/215; 401/218

(58) Field of Classification Search
USPC ..... 401/208–218
See application file for complete search history.

(56) References Cited

U.S. PATENT DOCUMENTS

| | | | | | |
|---|---|---|---|---|---|
| 392,046 | A | * | 10/1888 | Loud | 401/212 |
| 538,492 | A | * | 4/1895 | Askew | 401/212 |
| 555,763 | A | * | 3/1896 | Fessender | 401/212 |
| 600,299 | A | * | 3/1898 | Werner | 401/214 |
| 853,156 | A | * | 5/1907 | Brenton | 401/214 |
| 1,373,146 | A | * | 3/1921 | Parkinson | 401/212 |
| 1,980,625 | A | * | 11/1934 | Laforest et al. | 401/143 |
| 2,208,588 | A | * | 7/1940 | Laforest | 401/212 |
| 2,485,224 | A | * | 10/1949 | Wahl | 401/212 |
| 2,602,423 | A | * | 7/1952 | Smith | 401/143 |
| 2,797,685 | A | * | 7/1957 | Packwood | 601/131 |

(Continued)

FOREIGN PATENT DOCUMENTS

| | | | |
|---|---|---|---|
| CN | 2846157 | Y | 12/2006 |
| CN | 200960786 | Y | 10/2007 |
| FR | 2665649 | | 2/1992 |
| GB | 623767 | A | 5/1949 |
| JP | 60-150079 | U | 10/1985 |
| JP | 6-21775 | U | 3/1994 |
| JP | 06-293195 | | 10/1994 |
| JP | 06-336098 | | 12/1994 |
| JP | 07-172094 | | 7/1995 |
| JP | 08-089874 | | 4/1996 |
| JP | 2004-50475 | A | 2/2004 |
| JP | 2004-106485 | | 4/2004 |
| JP | 2004-130749 | | 4/2004 |
| WO | WO 01/62519 | A1 | 8/2001 |

*Primary Examiner* — David J. Walczak
*Assistant Examiner* — Joshua Wiljanen
(74) *Attorney, Agent, or Firm* — Wood, Phillips, Katz, Clark & Mortimer

(57) ABSTRACT

It is an aim to provide a tip unit for a liquid applicator and a liquid applicator that make written (applied) lines to change in thickness and give excellent durability. A tip unit used for a liquid applicator includes a ball house having an opening at its distal end and an introduction channel for application liquid in communication with the ball house, wherein the ball house holds therein at least two balls having a leading ball and an adjacent ball next to the leading ball, the balls being serially lined in an axial direction of the tip unit, the leading ball being partly exposed outside from the opening, and the leading ball being softer than the adjacent ball.

13 Claims, 2 Drawing Sheets

(56) References Cited

U.S. PATENT DOCUMENTS

| | | | | | |
|---|---|---|---|---|---|
| 2,969,583 | A * | 1/1961 | Schachter | 29/898.041 |
| 3,877,619 | A * | 4/1975 | Chavez, Jr. | 222/494 |
| 3,960,455 | A * | 6/1976 | Balassiano | 401/209 |
| 5,957,609 | A * | 9/1999 | Morita et al. | 401/214 |
| 6,494,634 | B1 * | 12/2002 | Inoue et al. | 401/216 |
| 6,554,521 | B1 * | 4/2003 | Kobayashi | 401/206 |
| 6,837,640 | B2 * | 1/2005 | Kobayashi | 401/206 |
| 6,887,008 | B2 * | 5/2005 | Kitao et al. | 401/219 |

* cited by examiner

TIP UNIT FOR LIQUID APPLICATOR AND LIQUID APPLICATOR

TECHNICAL FIELD

The present invention relates to tip units for liquid applicators, especially to a tip unit for a liquid applicator provided with a ball for application, and to a liquid applicator using such the tip unit. In this specification, a "liquid applicator" denotes an instrument for applying liquid such as an ink, a correction liquid, a liquid glue, and a drug and is partly the same in concept with a "writing instrument".

BACKGROUND ART

There are conventionally known writing instruments such as ball-point pens and felt-tip pens as liquid applicators. Commercially available ball-point pens each generally incorporate a ball for application made of a hard material such as tungsten cemented carbide, stainless steel, and ceramic in a tip unit of a pen tip.

On the other hand, liquid applicators of a ball-point pen type incorporating a ball made of an elastic body such as rubber in a tip unit of a pen tip have been proposed as disclosed in Patent Documents 1 to 3.

PATENT DOCUMENT

Patent Document 1: JP 60-150079 U
Patent Document 2: JP 2004-50475 A
Patent Document 3: JP 6-21775 U

DISCLOSURE OF INVENTION

Technical Problem

However, the conventional liquid applicators still have room for improvement. For the purpose of writing instruments (liquid applicators) by which young children draw pictures, for example, a ball-point pen is unsuitable for drawing pictures because lines written by such a pen are normally fine and have no change in thickness. Although a felt-tip pen can provide wide written lines and are popular with young children for being of variable thickness of written lines by changing the orientation of its tip, the pen has a disadvantage in its perishable tip of a felt core. Young children draw pictures holding pens with their fists and cannot control their force well, thus easily breaking tips of felt cores.

Further, the liquid applicators described in Patent Documents 1 to 3 have not widely become commercially available though having been proposed quite early on. That is assumedly because a ball is difficult to rotate. The present inventors, as well as the inventions described in Patent Documents 1 to 3, conducted writing experiments employing a ball made of an elastic body, but the ball would not rotate enough, resulting in difficulty in writing.

It is therefore an aim to be solved in the present invention to provide a tip unit for a liquid applicator having a ball adequately rotating, allowing written (applied) lines to change in thickness, and giving excellent durability, and a liquid applicator.

Solution to Problem

One aspect of the present invention is a tip unit used for a liquid applicator, the tip unit including a ball house having an opening at its distal end and an introduction channel for application liquid in communication with the ball house, wherein the ball house holds therein at least two balls having a leading ball and an adjacent ball next to the leading ball, the balls being serially lined in an axial direction of the tip unit, the leading ball being partly exposed outside from the opening, and the leading ball being softer than the adjacent ball.

The prevent inventors conducted writing experiments employing a ball of a ball-point pen, the ball being made of an elastic body, but the ball would not rotate. Thus, they examined the inside of a tip unit by experimentally producing a transparent tip unit and found that the ball was deformed to be pressed onto a ball seat, resulting in failing to rotate. So, after earnest studies, the present inventors brought two balls into line in a ball house, specifically with a ball made of a soft material arranged at the head (a position nearest to a writing surface) and a hard ball arranged therebehind (a side near the ball seat) and conducted writing experiments. As a result, the ball arranged behind functioned as a bearing, so that the both balls rotated. Herein, in a case where the both balls were soft, they failed to rotate. Furthermore, the inventors reached the present invention, finding that, even when more than two balls were arranged in a ball house, the balls rotated if a leading ball was softer than a ball adjacent thereto.

An application liquid used in the tip unit in the present aspect is not particularly limited and includes an ink, a correction liquid, a liquid glue, and a drug. In a case of using an ink as the application liquid, for example, it is expected to add an adjective contained in a normal ink, such as a colorant, a viscosity modifier, a preservative, a surfactant, and an antifoam.

Preferably, the ball house holds therein two balls consisting of a leading ball and an adjacent ball next to the leading ball.

According to this preferable aspect, the problem is solved with a minimum number of balls. In short, it is possible to embody the invention using more than two balls, but it is preferable to employ two balls for simplifying a configuration.

Preferably, the leading ball is made of an elastic material, and the adjacent ball is made of a hard material.

Herein, an "elastic material" denotes a material that is deformed by stress and specifically includes natural rubber, synthetic rubber, and thermoplastic elastomer. More specifically, it includes silicone rubber, ethylene-propylene rubber, nitrile rubber, fluoro rubber (copolymer of vinylidene fluoride and hexafluoropropylene, for example), urethane rubber, isoprene rubber, butadiene rubber, styrene-butadiene rubber, chloroprene rubber, acrylonitrile-butadiene rubber, butyl rubber, chlorosulfonated polyethylene, acrylic rubber, epichlorohydrin rubber, polysulfide rubber, and ethylene-vinyl acetate copolymer, but is not limited thereto. It can also be of foam.

Further, the leading ball may be made of an elastic material in whole, may be made of a hard ball covered with an elastic material, and may be made of a hollow elastic material.

Herein, a "hard material" denotes a material that is virtually undeformable by stress, and specifically includes metal, non-foam resin, and ceramic, but is not limited thereto. More specifically, it includes cemented carbide, tungsten steel, carbon steel, polyethylene, polypropylene, polyoxymethylene, tetrafluoroethylene resin, ruby, and sapphire, but is not limited thereto. Herein, "cemented carbide" is of composite materials containing carbide of IVa, Va, VIa group metals of the periodic table sintered with iron-like metal such as Fe, Co, Ni, Cr, and Ti and includes a sintered body of tungsten carbide and cobalt as an example.

Preferably, the elastic material has a hardness of up to 95 of the Type A durometer hardness compliant with JIS K6253.

Preferably, the elastic material has a hardness of up to 65 of the Type A durometer hardness compliant with JIS K6253.

Preferably, the elastic material has a surface roughness of 1.1 or more of the arithmetic mean roughness compliant with JIS B0601-1994.

Preferably, the elastic material is selected from a group consisting of silicone rubber and fluoro rubber.

By this preferred aspect, when the leading ball is made of silicone rubber, the balls smoothly rotate. When the leading ball is made of fluoro rubber, the ball has a high resistance to ink.

Preferably, the hard material has a hardness of 100 of the Type A durometer hardness compliant with JIS K6253.

In this specification, "hardness" is never beyond 100 by its definition.

Preferably, the hard material has a surface roughness of 0.5 or more of the arithmetic mean roughness compliant with JIS B0601-1994.

Preferably, the hard material is tetrafluoroethylene resin.

By this preferred aspect, when the adjacent ball next to the leading ball is made of tetrafluoroethylene resin, the balls smoothly rotate.

Preferably, the ball house has a ball seat in the vicinity of a rearmost ball and is provided with an urging member between the rearmost ball and the ball seat for urging the rearmost ball to the distal end.

The "rearmost ball" denotes a ball farthest from the leading ball. In a case of two balls in the ball house, the "ball next to the leading ball" is the "rearmost ball". By this preferred aspect, a force by which the leading ball is pressed against a surface on which an application liquid is applied is adjusted by a force urging the rearmost ball by the urging member.

Preferably, the leading ball has a diameter of 1 mm to 20 mm.

Herein, the "ball next to the leading ball" preferably has the substantially same diameter as that of the leading ball. That is because the tip unit is easily produced when the "ball next to the leading ball" has a diameter not larger than that of the leading ball, but the former not smaller than the latter facilitates rotation of the balls.

Another aspect of the present invention is a liquid applicator including an ink reservoir reserving ink and the tip unit according to any preceding aspect and connected to the ink reservoir.

The liquid applicator in this aspect makes the balls to smoothly rotate and enables written lines to change in thickness.

Advantageous Effect of Invention

The tip unit for a liquid applicator and the liquid applicator in this invention enable written (applied) lines to change in thickness, thereby appealing more to young children. Further, it is possible to provide a tip unit for a liquid applicator and a liquid applicator having excellent durability. Still further, it makes possible to write (apply) on an indented surface, on which the conventional ball-point pen could not have written.

DESCRIPTION OF EMBODIMENTS

Figure 1:
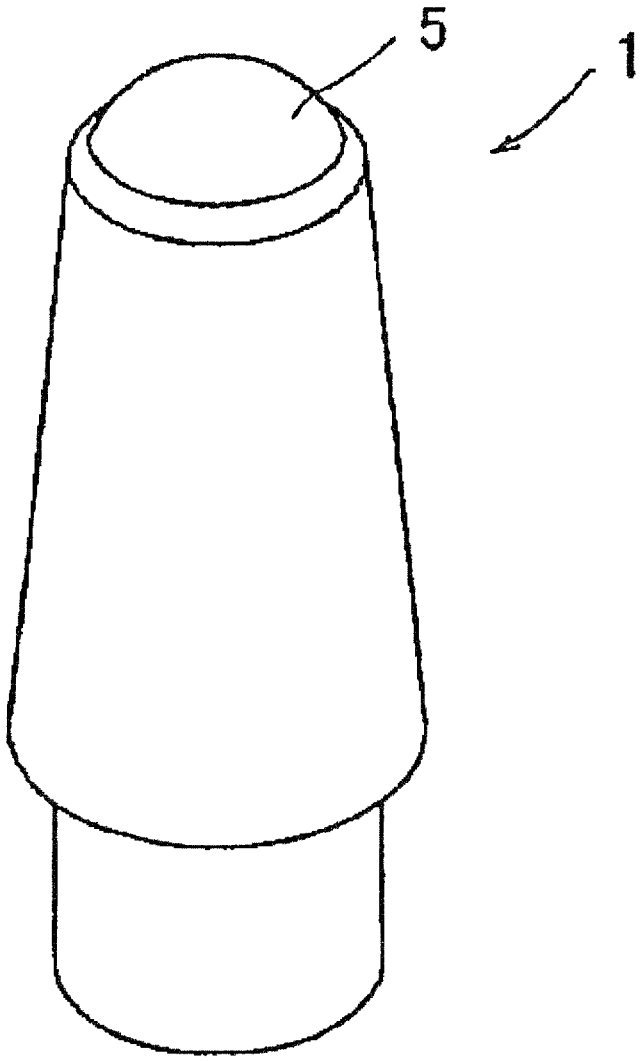
FIG. 1 is a perspective view of a tip unit for a ball-point pen in an embodiment of a tip unit for a liquid applicator of the present invention.
Figure 2:
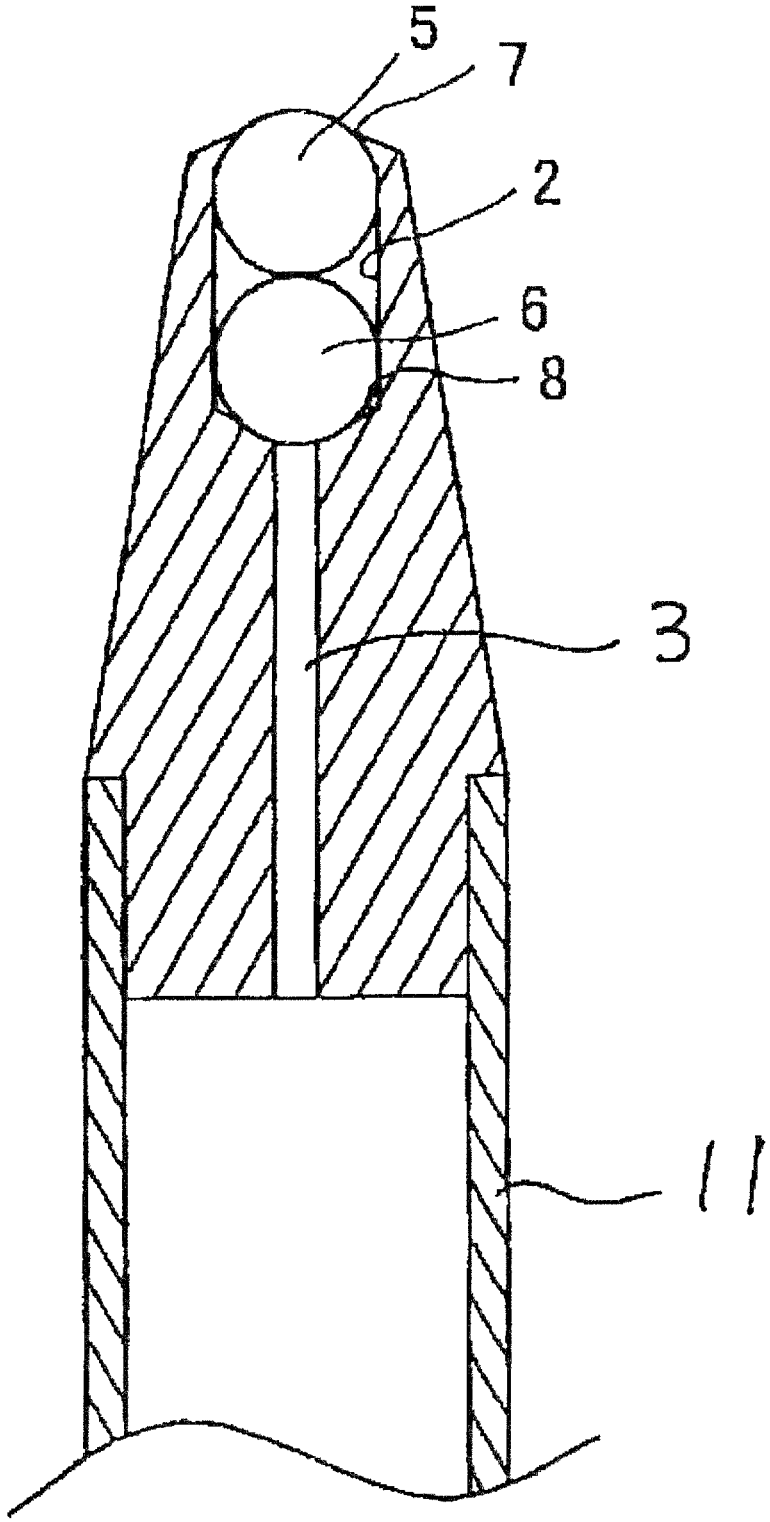
FIG. 2 is a cross-section showing a distal end portion of a ball-point pen incorporating the tip unit for a ball-point pen shown in FIG. 1.

Referring to FIG. 1, a tip unit 1 for a liquid applicator includes a ball house 2 at its distal end portion and an ink introduction channel (introduction channel for application liquid) 3 in communication with the ball house 2. The ball house 2 rotatively incorporates and holds a leading ball (hereinafter referred to as a front ball) 5 and an adjacent ball next thereto (hereinafter referred to as a rear ball) 6. The balls 5 and 6 are serially lined in an axial direction of the tip unit and contact with each other, the front ball 5 being made of an elastic body and the rear ball 6 being made of a hard body. In other words, an elastic ball is arranged at the forefront and a hard ball is arranged behind it. The front ball 5 is partly exposed outside from a distal opening 7 of the ball house. The rear ball 6 contacts with a ball seat 8 of a substantially conical trapezoid at its rear end. The ball seat 8 opens at its center for the ink introduction channel 3. The front ball 5 (made of an elastic body) is softer than the rear ball 6 (made of a hard body) next thereto.

The tip unit 1 is connected to an ink reservoir 11 at its proximal end. The ink reservoir 11 functions as a holding part and has therein an ink reserving part (not shown) that reserves ink (application liquid). The ink reserving part is communicated with the ink introduction channel (introduction channel for application liquid) 3, so that ink is fed from the ink reserving part via the ink introduction channel 3 to the ball house 2. The ink fed to the ball house 2 is applied on a surface on which it is to be applied (not shown) through surfaces of the balls 5 and 6 as the rear ball 6 and the front ball 5 rotate.

EXAMPLES

Writing experiments were conducted with ball-point pens experimentally produced by using rubber balls (elastic balls) and hard balls, the both balls being made of various materials. However, the present invention is not limited by materials, compositions, and figures used in the experiments described herein.

Eight kinds of rubber balls and five kinds of hard balls made of different is materials were prepared. Ball-point pens were produced by using all combinations (40 different combinations) of those balls, each combination being arranged with a rubber ball in front and a hard ball behind the rubber ball in the ball house. These ball-point pens each underwent writing experiments on five kinds of writing surfaces (surfaces on which a liquid is to be applied). That means 200 different examples of experiments were conducted. The rubber balls and the hard balls each had an outer diameter of 6.35 mm (¼ inch).

The following eight kinds of materials were selected as materials constituting the rubber balls.

Silicone rubber
Ethylene propylene rubber (EPDM) (three kinds)
Nitrile rubber (NBR)
Fluoro rubber ("Viton" a registered trademark of DuPont Performance Elastomers L.L.C) (two kinds)
Urethane rubber The hardness and the surface roughness of these eight kinds of materials were measured. The results of measurements are shown in Table 1. Herein, the hardness is shown by the Type A durometer hardness compliant with JIS K6253. The surface roughness is shown by the surface roughness Ra (arithmetic mean roughness) compliant with JIS B0601-1994 and measured with the VK-8500 Ultra-Deep Shape Measuring Microscope manufactured by Keyence Corp. as a measurement device.

TABLE 1

| | Silicone rubber | Ethylene propylene rubber (EPDM) | | | Nitrile rubber (NBR) | Fluoro rubber | | Urethane rubber |
|---|---|---|---|---|---|---|---|---|
| Hardness | 65 | 60 | 66 | 70 | 69 | 74 | 80 | 95 |
| Surface roughness | 1.63 | 2.05 | 1.03 | 1.60 | 0.81 | 0.56 | 0.79 | 1.57 |

The following five kinds of materials were selected as materials constituting the hard balls.

Cemented carbide (sintered body of tungsten carbide and cobalt)

High-density polyethylene (PE(HD))

Polypropylene (PP)

Polyoxymethylene (POM) ("Delrin" a registered trademark of DuPont Performance Elastomers L.L.C)

Tetrafluoroethylene resin (PTFE) ("Teflon" a registered trademark of DuPont Performance Elastomers L.L.C)

The hardness and the surface roughness of these five kinds of materials were measured. The results of measurements are shown in Table 2. Herein, the hardness is shown by the Type A durometer hardness compliant with JIS K6253. The surface roughness is shown by the surface roughness Ra (arithmetic mean roughness) compliant with JIS B0601-1994 and measured with the VK-8500 Ultra-Deep Shape Measuring Microscope manufactured by Keyence Corp. as a measurement device.

TABLE 2

| | Cemented carbide | High-density polyethylene (PE(HD)) | Polypropylene (PP) | Polyoxymethylene (POM) | Tetrafluoroethylene resin (PTFE) |
|---|---|---|---|---|---|
| Rubber hardness | 100 | 100 | 100 | 100 | 100 |
| Surface roughness | 0.21 | 0.27 | 0.31 | 0.42 | 0.68 |

The following five kinds of materials were selected as writing surfaces.

Glass

Stainless steel (Mirror finish)

Stainless steel (Hairline finish)

High-quality paper

White board (coated white board)

Two kinds of inks, water-base ink and aqueous gel ink, were selected as application liquids. The properties of the inks are as follows.

[Water-base Ink]

Viscosity: 5 mPa·S (shear viscosity measured with the E-type ELD viscometer manufactured by Tokimec Inc. at 20 degree centigrade with a 1 degree 34'R24 cone at a rotation speed of 50 rpm)

Component: coloring material (pigment) 10%, water 50%, wetter 30%, and other additives 10%

[Aqueous Gel Ink]

Viscosity: 100 mPa·S (shear viscosity measured with the E-type ELD viscometer manufactured by Tokimec Inc. at 20 degree centigrade with a 3 degree 14'R24 cone at a rotation speed of 0.5 rpm)

Component: coloring material (pigment) 10%, water 65%, wetter 20%, and other additives 5%

The results of experiments were as shown in Table 3 below. The letters A~E on Table 3 and Tables 4~6 described below denote as follows. Herein, in either result, no difference was produced among the kinds of the inks.

A: Both the front ball and the rear ball rotated.

B: Both the front ball and the rear ball rotated, but slippage was sometimes caused.

C: Only the front ball rotated, but the rear ball did not rotate.

D: Only the front ball rotated, but slippage was sometimes caused. The rear ball did not rotate.

E: Neither the front ball nor the rear ball rotated.

TABLE 3

| | | | | | | Rear ball | | | | |
|---|---|---|---|---|---|---|---|---|---|---|
| | | | | | | Ball material | | | | |
| | | | | | | Cemented carbide | PE | PP | POM | PTFE |
| | | | | | | Hardness | | | | |
| | | | | | | 100 | 100 | 100 | 100 | 100 |
| | | | | | | Surface roughness | | | | |
| | Ball material | Hardness | Surface roughness | | | 0.21 | 0.27 | 0.31 | 0.42 | 0.68 |
| Front ball | Silicone rubber (Silicone) | 65 | 1.63 | Writing surface | Glass | A | A | A | A | A |
| | | | | | Stainless steel (Mirror finish) | A | A | A | A | A |
| | | | | | Stainless steel (Hairline finish) | A | A | A | A | A |
| | | | | | Paper (High-quality paper) | A | A | A | A | A |
| | | | | | White board | A | A | B | A | A |
| | Ethylene propylene rubber (EPDM) | 60 | 2.05 | Writing surface | Glass | A | A | A | A | A |
| | | | | | Stainless steel (Mirror finish) | A | A | A | A | A |
| | | | | | Stainless steel (Hairline finish) | B | A | A | A | A |
| | | | | | Paper (High-quality paper) | B | A | B | A | A |
| | | | | | White board | A | A | A | A | A |
| | | 66 | 1.03 | Writing surface | Glass | E | B | B | B | A |
| | | | | | Stainless steel (Mirror finish) | E | B | B | B | A |
| | | | | | Stainless steel (Hairline finish) | E | B | B | B | A |
| | | | | | Paper (High-quality paper) | E | B | B | B | A |
| | | | | | White board | B | B | B | B | B |
| | | 70 | 1.60 | Writing surface | Glass | E | A | B | B | B |
| | | | | | Stainless steel (Mirror finish) | E | B | B | B | B |
| | | | | | Stainless steel (Hairline finish) | E | B | B | B | E |
| | | | | | Paper (High-quality paper) | E | B | B | E | E |
| | | | | | White board | E | B | B | E | B |
| | Nitrile rubber (NBR) | 69 | 0.81 | Writing surface | Glass | B | B | B | B | A |
| | | | | | Stainless steel (Mirror finish) | E | E | E | B | A |
| | | | | | Stainless steel (Hairline finish) | E | E | E | E | A |
| | | | | | Paper (High-quality paper) | E | B | B | B | A |
| | | | | | White board | E | E | E | E | B |
| | Fluoro rubber | 74 | 0.56 | Writing surface | Glass | E | B | B | B | B |
| | | | | | Stainless steel (Mirror finish) | E | E | E | E | B |
| | | | | | Stainless steel (Hairline finish) | E | E | E | E | E |
| | | | | | Paper (High-quality paper) | E | A | B | E | A |
| | | | | | White board | E | E | E | E | E |
| | | 80 | 0.79 | Writing surface | Glass | E | E | E | E | E |
| | | | | | Stainless steel (Mirror finish) | E | E | E | E | E |
| | | | | | Stainless steel (Hairline finish) | E | E | E | E | E |
| | | | | | Paper (High-quality paper) | E | E | E | E | E |
| | | | | | White board | E | B | B | E | B |
| | Urethane rubber (Urethane) | 95 | 1.57 | Writing surface | Glass | E | E | E | E | C |
| | | | | | Stainless steel (Mirror finish) | E | E | E | E | C |
| | | | | | Stainless steel (Hairline finish) | E | B | E | A | C |
| | | | | | Paper (High-quality paper) | A | B | A | A | C |
| | | | | | White board | E | E | E | E | D |

The results shown in Table 3 will be described in detail below comparing with comparative experiments below.

Ball-point pens described below were produced as comparative examples and reference examples and underwent the same writing experiments as those of the above-mentioned examples. Each ball had an outer diameter of 6.35 mm (¼ inch).

(1) Ball-point pen having two rubber (elastic) balls serially arranged in the ball house (2) Ball-point pen having two hard balls serially arranged in the ball house (3) Ball-point pen having a hard ball as the front ball and a rubber (elastic) ball as the rear ball The ball-point pens described in (1) above were produced by all combinations of the front ball selected from the same eight kinds of rubber balls as those of the ball-point pens in the examples and the rear ball selected from five kinds of rubber balls selected from the above-mentioned eight kinds. These ball-point pens each underwent writing experiments (200 different examples) on the five kinds of writing surfaces (surfaces on which a liquid is to be applied).

The ball-point pens described in (2) above were produced by all combinations of the front ball selected from the same five kinds of hard balls as those of the ball-point pens in the examples and the rear ball selected from the same five kinds of hard balls as the latter. These ball-point pens each underwent writing experiments (125 different examples) on the five kinds of writing surfaces (surfaces on which a liquid is to be applied).

The ball-point pens described in (3) above were produced by all combinations of the front ball selected from the same five kinds of hard balls as those of the ball-point pens in the examples and the rear ball selected from five kinds of rubber balls selected from the above-mentioned eight kinds of rubber balls. These ball-point pens each underwent writing experiments (125 different examples) on the five kinds of writing surfaces (surfaces on which a liquid is to be applied).

The results of the writing experiments of the ball-point pens (1) are shown in Table 4.

TABLE 4

| | | | | | | Rear ball | | | | |
|---|---|---|---|---|---|---|---|---|---|---|
| | | | | | | Ball material | | | | |
| | | | | | | Silicone | EPDM | NBR | Fluoro rubber | Urethane |
| | | | | | | Hardness | | | | |
| | | | | | | 65 | 66 | 69 | 74 | 95 |
| | Ball | | Surface | | | Surface roughness | | | | |
| | material | Hardness | roughness | | | 1.63 | 1.03 | 0.81 | 0.56 | 1.57 |
| Front ball | Silicone rubber (Silicone) | 65 | 1.63 | Writing surface | Glass | E | E | E | E | B |
| | | | | | Stainless steel (Mirror finish) | E | E | E | E | E |
| | | | | | Stainless steel (Hairline finish) | E | E | E | E | E |
| | | | | | Paper (High-quality paper) | E | E | E | E | B |
| | | | | | White board | E | E | E | E | E |
| | Ethylene propylene rubber (EPDM) | 60 | 2.05 | Writing surface | Glass | E | E | E | E | B |
| | | | | | Stainless steel (Mirror finish) | E | E | E | E | B |
| | | | | | Stainless steel (Hairline finish) | E | E | E | E | E |
| | | | | | Paper (High-quality paper) | E | E | E | E | E |
| | | | | | White board | E | E | E | E | B |
| | | 66 | 1.03 | Writing surface | Glass | E | E | E | E | B |
| | | | | | Stainless steel (Mirror finish) | E | E | E | E | B |
| | | | | | Stainless steel (Hairline finish) | E | E | E | E | E |
| | | | | | Paper (High-quality paper) | E | E | E | E | E |
| | | | | | White board | E | E | E | E | E |
| | | 70 | 1.60 | Writing surface | Glass | E | E | E | E | B |
| | | | | | Stainless steel (Mirror finish) | E | E | E | E | B |
| | | | | | Stainless steel (Hairline finish) | E | E | E | E | E |
| | | | | | Paper (High-quality paper) | E | E | E | E | E |
| | | | | | White board | E | E | E | E | B |
| | Nitrile rubber (NBR) | 69 | 0.81 | Writing surface | Glass | E | E | E | E | E |
| | | | | | Stainless steel (Mirror finish) | E | E | E | E | E |
| | | | | | Stainless steel (Hairline finish) | E | E | E | E | E |
| | | | | | Paper (High-quality paper) | E | E | E | E | E |
| | | | | | White board | E | E | E | E | E |
| | Fluoro rubber | 74 | 0.56 | Writing surface | Glass | E | E | E | E | E |
| | | | | | Stainless steel (Mirror finish) | E | E | E | E | E |

TABLE 4-continued

| | | | | | Rear ball | | | | |
|---|---|---|---|---|---|---|---|---|---|
| | | | | | Ball material | | | | |
| | | | | | Silicone | EPDM | NBR | Fluoro rubber | Urethane |
| | | | | | Hardness | | | | |
| | | | | | 65 | 66 | 69 | 74 | 95 |
| | | | | | Surface roughness | | | | |
| Ball material | Hardness | Surface roughness | | | 1.63 | 1.03 | 0.81 | 0.56 | 1.57 |
| | | | | Stainless steel (Hairline finish) | E | E | E | E | E |
| | | | | Paper (High-quality paper) | E | E | E | E | E |
| | | | | White board | E | E | E | E | E |
| | 80 | 0.79 | Writing surface | Glass | E | E | E | E | E |
| | | | | Stainless steel (Mirror finish) | E | E | E | E | E |
| | | | | Stainless steel (Hairline finish) | E | E | E | E | E |
| | | | | Paper (High-quality paper) | E | E | E | E | E |
| | | | | White board | E | E | E | E | E |
| Urethane rubber (Urethane) | 95 | 1.57 | Writing surface | Glass | E | E | E | E | E |
| | | | | Stainless steel (Mirror finish) | E | E | E | E | E |
| | | | | Stainless steel (Hairline finish) | E | E | E | E | E |
| | | | | Paper (High-quality paper) | E | E | E | E | E |
| | | | | White board | E | E | E | E | E |

The results of the writing experiments of the ball-point pens (2) are shown in Table 5.

TABLE 5

| | | | | | | Rear ball | | | | |
|---|---|---|---|---|---|---|---|---|---|---|
| | | | | | | Ball material | | | | |
| | | | | | | Cemented carbide | PE (HD) | PP | POM | PTFE |
| | | | | | | Hardness | | | | |
| | | | | | | 100 | 100 | 100 | 100 | 100 |
| | | | Surface | | | Surface roughness | | | | |
| | Ball material | Hardness | roughness | | | 0.21 | 0.27 | 0.31 | 0.42 | 0.68 |
| Front ball | Cemented carbide | 100 | 0.21 | Writing surface | Glass | E | E | D | E | D |
| | | | | | Stainless steel (Mirror finish) | E | E | E | D | C |
| | | | | | Stainless steel (Hairline finish) | E | E | E | D | C |
| | | | | | Paper (High-quality paper) | E | E | B | D | C |
| | | | | | White board | E | C | C | C | C |
| | High-density polyethylene (PE(HD)) | 100 | 0.27 | Writing surface | Glass | E | E | E | E | D |
| | | | | | Stainless steel (Mirror finish) | D | E | D | D | C |
| | | | | | Stainless steel (Hairline finish) | C | C | C | C | C |
| | | | | | Paper (High-quality paper) | C | C | C | C | C |
| | | | | | White board | C | C | D | D | C |
| | Polypropylene (PP) | 100 | 0.31 | Writing surface | Glass | E | E | E | E | C |
| | | | | | Stainless steel (Mirror finish) | E | C | E | C | C |
| | | | | | Stainless steel (Hairline finish) | C | C | C | C | C |
| | | | | | Paper (High-quality paper) | C | C | C | C | C |
| | | | | | White board | D | D | C | C | C |

TABLE 5-continued

| | | | | | Rear ball | | | | |
|---|---|---|---|---|---|---|---|---|---|
| | | | | | Ball material | | | | |
| | | | | | Cemented carbide | PE (HD) | PP | POM | PTFE |
| | | | | | Hardness | | | | |
| | | | | | 100 | 100 | 100 | 100 | 100 |
| | | Surface | | | Surface roughness | | | | |
| Ball material | Hardness | roughness | | | 0.21 | 0.27 | 0.31 | 0.42 | 0.68 |
| Polyoxymethylene (POM) | 100 | 0.42 | Writing surface | Glass | E | E | E | E | D |
| | | | | Stainless steel (Mirror finish) | D | D | C | C | C |
| | | | | Stainless steel (Hairline finish) | C | C | C | C | C |
| | | | | Paper (High-quality paper) | C | C | C | C | C |
| | | | | White board | D | D | D | C | C |
| Tetrafluoroethylene resin (PTFE) | 100 | 0.68 | Writing surface | Glass | E | E | E | E | E |
| | | | | Stainless steel (Mirror finish) | E | E | E | E | E |
| | | | | Stainless steel (Hairline finish) | C | C | C | E | C |
| | | | | Paper (High-quality paper) | C | C | C | C | C |
| | | | | White board | E | E | E | E | E |

The results of the writing experiments of the ball-point pens (3) are shown in Table 6.

TABLE 6

| | | | | | | Rear ball | | | | |
|---|---|---|---|---|---|---|---|---|---|---|
| | | | | | | Ball material | | | | |
| | | | | | | Silicone | EPDM | NBR | Fluoro rubber | Urethane |
| | | | | | | Hardness | | | | |
| | | | | | | 65 | 66 | 69 | 74 | 95 |
| | | | Surface | | | Surface roughness | | | | |
| | Ball material | Hardness | roughness | | | 1.63 | 1.03 | 0.81 | 0.56 | 1.57 |
| Front ball | Cemented carbide | 100 | 0.21 | Writing surface | Glass | E | E | E | E | E |
| | | | | | Stainless steel (Mirror finish) | E | E | E | E | E |
| | | | | | Stainless steel (Hairline finish) | E | E | E | E | E |
| | | | | | Paper (High-quality paper) | E | E | E | E | E |
| | | | | | White board | E | E | E | E | E |
| | High-density polyethylene (PE(HD)) | 100 | 0.27 | Writing surface | Glass | E | E | E | E | E |
| | | | | | Stainless steel (Mirror finish) | E | E | E | E | E |
| | | | | | Stainless steel (Hairline finish) | E | E | E | E | E |
| | | | | | Paper (High-quality paper) | E | E | E | E | E |
| | | | | | White board | E | E | E | E | E |
| | Polypropylene (PP) | 100 | 0.31 | Writing surface | Glass | E | E | E | E | E |
| | | | | | Stainless steel (Mirror finish) | E | E | E | E | E |
| | | | | | Stainless steel (Hairline finish) | E | E | E | E | E |
| | | | | | Paper (High-quality paper) | E | E | E | E | E |
| | | | | | White board | E | E | E | E | E |
| | Polyoxymethylene (POM) | 100 | 0.42 | Writing surface | Glass | E | E | E | E | E |
| | | | | | Stainless steel (Mirror finish) | E | E | E | E | E |
| | | | | | Stainless steel (Hairline finish) | E | E | E | E | E |

TABLE 6-continued

| | | | | | Rear ball | | | | |
|---|---|---|---|---|---|---|---|---|---|
| | | | | | Ball material | | | | |
| | | | | | Silicone | EPDM | NBR | Fluoro rubber | Urethane |
| | | | | | Hardness | | | | |
| | | | | | 65 | 66 | 69 | 74 | 95 |
| | | Surface | | | Surface roughness | | | | |
| Ball material | Hardness | roughness | | | 1.63 | 1.03 | 0.81 | 0.56 | 1.57 |
| | | | | Paper (High-quality paper) | E | E | E | E | E |
| | | | | White board | E | E | E | E | E |
| Tetrafluoroethylene resin (PTFE) | 100 | 0.68 | Writing surface | Glass | E | E | E | E | E |
| | | | | Stainless steel (Mirror finish) | E | E | E | E | E |
| | | | | Stainless steel (Hairline finish) | E | E | E | E | E |
| | | | | Paper (High-quality paper) | E | E | E | E | E |
| | | | | White board | E | E | E | E | E |

Now, results of these four kinds of experiments will be compared. According to the comparative experiments, the balls of the ball-point pens (using the ball-point pen (1) in Table 4, comparative examples) each having the two rubber (elastic) balls serially arranged in the ball house hardly rotated. Specifically, as shown in Table 4, their evaluations were almost E, except that the use of the rear ball made of polyurethane showed B indicating defective rotation only in ten examples.

Some balls of the ball-point pens (using the ball-point pen (2) in Table 5, reference examples) each having the two hard balls serially arranged in the ball house did not rotate, but in many cases, only the front ball rotated and the rear ball did not rotate. Specifically, C and D in Table 5 constituted 82 examples among 125 examples. Among others, E constituted 42 examples and B indicating rotation of the both balls though defectively constituted only one example.

The balls of the ball-point pens (using the ball-point pen (3) in Table 6, reference examples arranged with the balls in the reversed position with those in is the present invention) each having the hard ball as the front ball and the rubber (elastic) ball as the rear ball did not rotate at all. Specifically, as shown in Table 6, their evaluations were all E.

Compared with these comparative and reference examples, some balls of the ball-point pens (in Table 3, embodiments) each having the rubber (elastic) ball as the front ball and the hard ball as the rear ball did not rotate (E), but in quite many cases, both the front and the rear balls rotated. Specifically, in Table 3, A constituted 61 examples among 200 examples and A and B constituted 117 examples among 200 examples. The rotational state of the balls, i.e., the writing (applying) state was relatively favorable as a whole.

Especially, the use of silicone rubber as the elastic material (material for the front ball) allowed both the front and the rear balls to rotate without slippage in almost all the cases, thereby ensuring smooth application. As to a specific combination with the hard material (material for the rear ball), the use of silicone rubber as the elastic material and any material selected from a group consisting of cemented carbide, high-density polyethylene, polypropylene, polyoxymethylene, and tetrafluoroethylene resin as the hard material allowed, in almost all the cases, both the front and the rear balls to rotate without slippage, thereby ensuring smooth application.

Whether the balls rotate or not in each case would depend on a combination of the materials for the three factors: the two balls and the writing is surface (or the materials for four factors: the three factors and also the ball seat). Though its mechanism has not been fully cleared, a certain level of consideration can be provided.

Presumably, the reason why the front ball and the rear ball rotated almost certainly without slippage when silicone rubber was used as the elastic material is that silicone rubber used for the front ball has a low hardness (hardness of 65) and has a large hardness difference from that of the hard material used for the rear ball.

Further, the use of ethylene propylene rubber having a hardness of 60 as the elastic material allowed both the front and the rear balls to rotate almost certainly without slippage.

By the above-mentioned experiments, the result in which both the front and the rear balls rotated without slippage though uncertainly was obtained when the front ball had a hardness below the hardness of urethane rubber (hardness of 95). Further, when silicone rubber having a hardness of 65 or ethylene propylene rubber having a hardness of 60 was used, both the front and the rear balls rotated almost certainly without slippage. Consequently, it is determined that the hardness of the elastic material suitable for the present invention is of up to 95 and particularly up to 65 of the Type A durometer hardness compliant with JIS K6253.

Herein, also presumably, the rotation of both the front and the rear balls almost certainly without slippage when silicone rubber was used as the front ball is attributed to the fact that silicone rubber has a surface roughness of 1.63, which is large among the elastic materials, of the arithmetic mean roughness compliant with JIS B0601-1994. The same can be said to ethylene propylene rubber having a hardness of 60 (2.05 of the arithmetic mean roughness). Materials having the second-largest arithmetic mean roughness among the elastic materials used in the experiments were ethylene propylene rubber having a hardness of 70 (1.60 thereof), urethane rubber (1.57 thereof), and ethylene propylene rubber having a hardness of 66 (1.03 thereof) in descending order. Therefore, considering only the arithmetic mean roughness, it can also be assumed that the surface roughness of the elastic material (front ball) required for rotating both the balls almost certainly is 1.6 or more. However, as described below, presumably, urethane rubber has a problem in its relatively-large hardness. Thus, considering except that, it is concluded that the surface roughness of the elastic material (front ball) required for rotating both the balls almost certainly is 1.1 or more.

Focusing on the material of the rear ball (hard material), some examples in which both the front and the rear balls rotated though with slippage (Table 4) when urethane rubber (hardness of 95) was used as the rear ball. Thus, taking a broader viewpoint, it can be also said that the rear ball (hard material) only needs a hardness above the hardness of urethane rubber (hardness of 95). However, it is preferable to use the hard material having a hardness of 100 to because both the front and the rear balls rotated without slippage though uncertainly in a case where the rear ball (hard material) has a hardness of 100.

When tetrafluoroethylene resin was used as the hard material (rear ball), the balls rotated without slippage in most cases, thereby ensuring a smooth application. This is assumedly because the surface roughness of tetrafluoroethylene resin is large for the hard material (roughness of 0.68). In particular, the use of tetrafluoroethylene rubber as the hard material and any material selected from a group consisting of silicone rubber, ethylene propylene rubber, and nitrile rubber allowed both the front and the rear balls to rotate without slippage in almost all the cases, thereby ensuring a smooth application.

The condition of the hard material (rear ball) required for rotating both the front and the rear balls almost certainly without slippage is judged to be above 0.5 of the surface roughness (the above-mentioned arithmetic means roughness). That is because the use of tetrafluoroethylene resin (roughness of 0.68) got good results and polyoxymethylene (roughness of 0.42) failed to get good results.

However, even though tetrafluoroethylene resin having a large surface roughness was used as the hard material (rear ball), only the font ball rotated (C and D in Table 3) when urethane rubber was used as the elastic material (front ball). Though the reason of that has not fully solved either, presumably it is that urethane rubber has a large hardness (hardness of 95) for rubber and is closer to a hard material. As shown in Table 5, in the case of the ball-point pens each having the two hard balls serially arranged, it was often the case that only the front ball rotated and the rear ball did not rotate. Presumably, the use of rubber to having a large hardness as the front ball would also cause the similar result as described above.

The descriptions above are the results of the experiments of the ball-point pens experimentally produced. In order to mass-produce ball-point pens, based on the results and/or conducting similar experiments more, it is only necessary to select an appropriate combination of an elastic ball and a hard ball.

Herein, though two balls were incorporated in the ball house in the above-mentioned embodiments, it is possible to incorporate and hold more than two balls in the ball house with a leading ball made of an elastic material and all other balls made of hard materials.

Further, it is also possible to provide an urging member between the rear ball and the ball seat for urging the rear ball toward the distal end.

| DESCRIPTION OF NUMERALS |
|---|
| 1. Tip unit for liquid applicator |
| 2. Ball house |
| 3. Ink introduction channel (Introduction channel for application liquid) |

-continued

| DESCRIPTION OF NUMERALS |
|---|
| 5. Front ball (Leading ball) |
| 6. Rear ball (Adjacent ball next to the leading ball) |
| 7. Opening |
| 8. Ball seat |

The invention claimed is:

1. A tip unit used for a liquid applicator, comprising:
a ball house having an opening at its distal end; and
an introduction channel for application liquid in communication with the ball house,
wherein the ball house holds therein at least two balls comprising a leading ball and an adjacent ball next to the leading ball,
the balls being serially lined in an axial direction of the tip unit,
the leading ball being partly exposed outside from the opening, and
the leading ball being softer than the adjacent ball.

2. The tip unit according to claim 1,
wherein the ball house holds therein two balls consisting of a leading ball and an adjacent ball next to the leading ball.

3. The tip unit according to claim 1,
the leading ball being made of an elastic material, and
the adjacent ball being made of a hard material.

4. The tip unit according to claim 3,
the elastic material having a hardness of up to 95 of the Type A durometer hardness compliant with JIS K6253.

5. The tip unit according to claim 3,
the elastic material having a hardness of up to 65 of the Type A durometer hardness compliant with JIS K6253.

6. The tip unit according to claim 3,
the elastic material having a surface roughness of 1.1 or more of the arithmetic mean roughness compliant with JIS B0601-1994.

7. The tip unit according to claim 3,
the elastic material being selected from a group consisting of silicone rubber and fluoro rubber.

8. The tip unit according to claim 3,
the hard material having a hardness of 100 of the Type A durometer hardness compliant with JIS K6253.

9. The tip unit according to claim 3,
the hard material having a surface roughness of 0.5 or more of the arithmetic mean roughness compliant with JIS B0601-1994.

10. The tip unit according to claim 3,
the hard material being tetrafluoroethylene resin.

11. The tip unit according to claim 1,
wherein the ball house has a ball seat in the vicinity of a rearmost ball and is provided with an urging member between the rearmost ball and the ball seat for urging the rearmost ball to the distal end.

12. The tip unit according to claim 1,
the leading ball having a diameter of 1 mm to 20 mm.

13. A liquid applicator comprising:
an ink reservoir reserving ink, and
the tip unit according to any one of the preceding claims connected to the ink reservoir.

* * * * *